US009354007B2

(12) United States Patent
Kruse

(10) Patent No.: US 9,354,007 B2
(45) Date of Patent: May 31, 2016

(54) FIREARM MAGAZINE HAVING NOSE-DIVE-CONTROL SPRING

(71) Applicant: I.P. Holding Group I, LLC, St. Louis, MO (US)

(72) Inventor: Russell E. Kruse, St. Charles, MO (US)

(73) Assignee: I.P. HOLDING GROUP I, LLC, St. Louis, MS (US)

( * ) Notice: Subject to any disclaimer, the term of this patent is extended or adjusted under 35 U.S.C. 154(b) by 297 days.

(21) Appl. No.: 13/797,279

(22) Filed: Mar. 12, 2013

(65) Prior Publication Data

US 2014/0259844 A1 Sep. 18, 2014

(51) Int. Cl.
*F41A 9/70* (2006.01)

(52) U.S. Cl.
CPC ..... *F41A 9/70* (2013.01)

(58) Field of Classification Search
CPC ..... F41A 9/54–9/58; F41A 9/65; F41A 9/70–9/71
USPC ..... 42/49.01, 50; 89/197
See application file for complete search history.

(56) References Cited

U.S. PATENT DOCUMENTS

| | | | | | |
|---|---|---|---|---|---|
| 403,765 | A | * | 5/1889 | Mauser | F41A 9/65 42/1.02 |
| 452,192 | A | | 5/1891 | Pitcher | |
| 1,351,370 | A | | 8/1920 | Chase | |
| 1,571,592 | A | | 2/1926 | Loomis | |
| 2,396,816 | A | * | 3/1946 | Boudreau | 42/50 |
| 2,840,944 | A | | 7/1958 | Thompson | |
| 2,870,561 | A | * | 1/1959 | Colby | 42/18 |
| 2,895,248 | A | | 7/1959 | Sawin | |
| 4,376,407 | A | * | 3/1983 | Hallqvist et al. | 89/20.2 |
| 4,502,237 | A | | 3/1985 | Krogh | |
| 4,811,510 | A | * | 3/1989 | Chesnut | 42/50 |
| 4,970,818 | A | * | 11/1990 | Vecchieschi | 42/50 |
| 5,014,456 | A | | 5/1991 | Kurtz et al. | |
| 5,099,595 | A | | 3/1992 | Chesnut et al. | |
| 5,153,359 | A | | 10/1992 | Lishness | |
| 5,285,590 | A | * | 2/1994 | Howard | F41A 9/70 42/50 |
| 5,319,871 | A | * | 6/1994 | Racheli | 42/50 |
| 5,375,359 | A | | 12/1994 | Chesnut et al. | |
| 5,502,913 | A | * | 4/1996 | Jackson | 42/50 |
| 5,615,505 | A | | 4/1997 | Vaid | |
| 6,898,888 | B2 | | 5/2005 | Greenhut | |
| 7,318,294 | B2 | | 1/2008 | Zimmermann | |
| 7,530,191 | B2 | | 5/2009 | Szabo | |

* cited by examiner

*Primary Examiner* — Stephen M Johnson
*Assistant Examiner* — Benjamin Gomberg
(74) *Attorney, Agent, or Firm* — Thompson Coburn LLP

(57) ABSTRACT

A cartridge magazine for housing a plurality of stacked cartridges and successively dispensing and guiding the uppermost one of the stacked cartridges from the magazine forward toward an inclined ramp leading to a chamber of a barrel of a firearm, the magazine comprising a housing portion and a nose-dive control spring. The nose-dive control spring comprises a resilient shank portion and a bullet-engageable end portion. The shank portion extends from one of the front and side walls to the bullet-engageable end portion. The nose-dive control spring is adapted and configured to prevent an uppermost cartridge from moving into a nose-dive orientation as a breech face of the firearm pushes the cartridge forward toward the inclined ramp of the firearm.

15 Claims, 2 Drawing Sheets

FIREARM MAGAZINE HAVING NOSE-DIVE-CONTROL SPRING

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to cartridge magazines for use in firearms.

SUMMARY OF THE INVENTION

One aspect of the invention is a cartridge magazine for housing a plurality of stacked cartridges and successively dispensing and guiding the uppermost one of the stacked cartridges from the magazine forward toward an inclined ramp leading to a chamber of a barrel of a firearm. The cartridge magazine comprises a housing portion, a magazine follower, a follower urging spring, and a nose-dive control spring. The housing portion comprises a front wall, a rear wall, first and second side walls, and a pair of cartridge retaining lips. Each of the first and second side walls are between the front wall and the rear wall. The front, rear and side walls define a cartridge compartment extending along a longitudinal housing axis. The cartridge compartment is adapted to contain a plurality of stacked cartridges. The cartridge compartment has a lower region and an upper region. The cartridge retaining lips are disposed along a respective upper edge margin of each of the first and second side walls. The magazine follower is within the cartridge compartment. The magazine follower is adapted and configured to move within the cartridge compartment generally along the housing axis. The follower urging spring is within the cartridge compartment. The follower urging spring is adapted and configured to urge the magazine follower toward the upper region of the cartridge compartment. The nose-dive control spring comprises a resilient shank portion and a bullet-engageable end portion. The shank portion extends from one of the front and side walls to the bullet-engageable end portion. The nose-dive control spring is adapted and configured such that as a cartridge having a casing and a bullet moves upwardly along the longitudinal housing axis into a retaining lips engaging position in which the cartridge retaining lips engage the casing of the cartridge, the bullet-engageable end portion is engaged by the bullet of the cartridge and forced outwardly until an upper portion of the bullet moves upwardly beyond the bullet-engageable end portion and the shank portion subsequently resiliently urges the bullet-engageable end portion inwardly into the upper portion of the cartridge compartment and under a lower portion of the bullet. The nose-dive control spring is adapted and configured to prevent the cartridge from moving into a nose-dive orientation as a breech face of the firearm pushes the cartridge forward toward the inclined ramp of the firearm.

Another aspect of the invention is a cartridge magazine for housing a plurality of stacked cartridges and successively dispensing and guiding the uppermost one of the stacked cartridges from the magazine forward toward an inclined ramp leading to a chamber of a barrel of a firearm. The magazine comprises a housing portion, a magazine follower, a follower urging spring, and a nose-dive control spring. The housing portion comprises a front wall, a rear wall, first and second side walls, and a pair of cartridge retaining lips. Each of the first and second side walls are between the front wall and the rear wall. The front, rear and side walls define a cartridge compartment extending along a longitudinal housing axis. The cartridge compartment is adapted to contain a plurality of stacked cartridges. The cartridge compartment has a lower region and an upper region. The cartridge retaining lips are disposed along a respective upper edge margin of each of the first and second side walls. The magazine follower is within the cartridge compartment. The magazine follower is adapted and configured to move within the cartridge compartment generally along the housing axis. The follower urging spring is within the cartridge compartment. The follower urging spring is adapted and configured to urge the magazine follower toward the upper region of the cartridge compartment. The nose-dive control spring comprises a resilient shank portion and a bullet-engageable end portion. The shank portion extends from one of the front and side walls to the bullet-engageable end portion. The nose-dive control spring is adapted and configured such that as a cartridge having a casing and a bullet moves upwardly along the longitudinal housing axis into a retaining lips engaging position in which the cartridge retaining lips engage the casing of the cartridge, the bullet-engageable end portion is engaged by the bullet of the cartridge and forced outwardly until an upper portion of the bullet moves upwardly beyond the bullet-engageable end portion and the shank portion subsequently resiliently urges the bullet-engageable end portion under a lower portion of the bullet. The nose-dive control spring is adapted and configured to prevent the cartridge from moving into a nose-dive orientation as a breech face of the firearm pushes the cartridge forward toward the inclined ramp of the firearm. The shank portion of the nose-dive control spring is generally flush with said one of the front and side walls when the nose-dive control spring is in an unflexed state.

Further features and advantages of the present invention, as well as the operation of the invention, are described in detail below with reference to the accompanying drawings.

Figure 1:
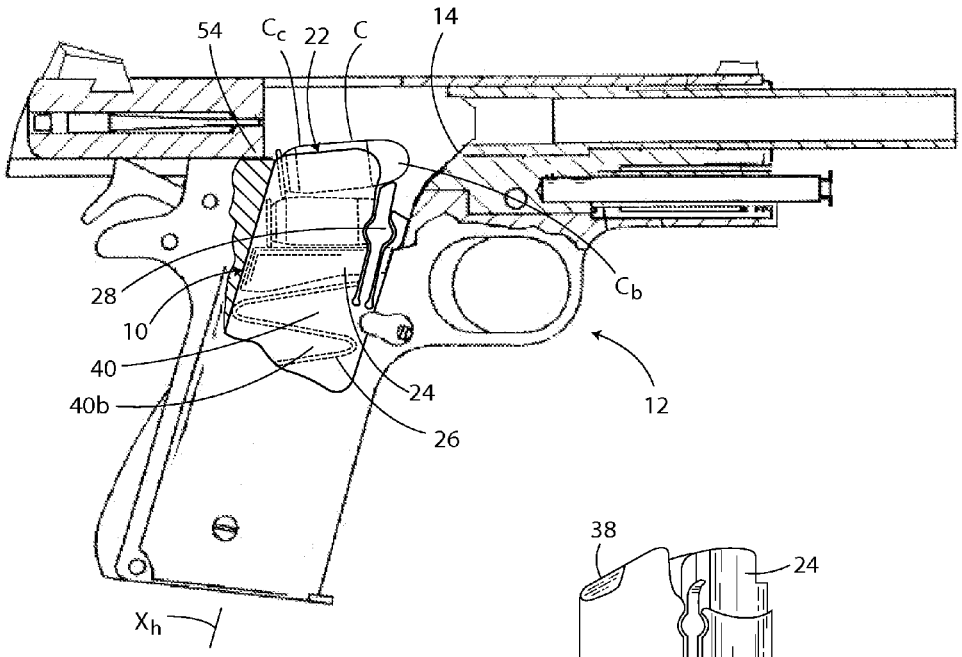
FIG. 1 is side elevational view of an embodiment of a cartridge magazine of the present invention positioned within a firearm.
Figure 2:
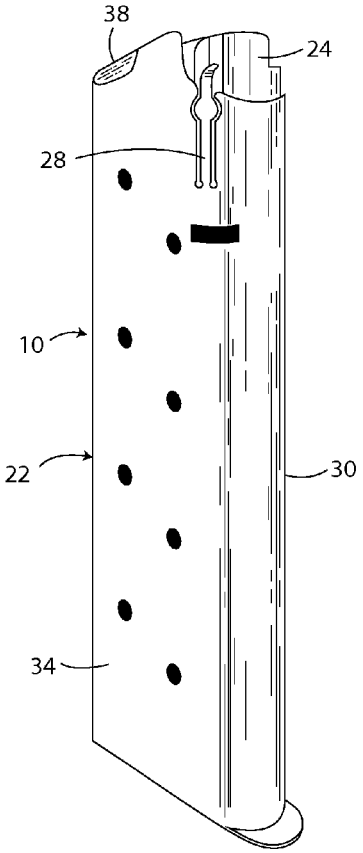
FIG. 2 is a perspective view of the cartridge magazine of FIG. 1.

Reference numerals in the written specification and in the drawing figures indicate corresponding items.

DETAILED DESCRIPTION

A cartridge magazine of the present invention is generally indicated by reference numeral 10 in FIGS. 1-5. In FIG. 1, the cartridge magazine 10 is shown inserted in a firearm 12. Portions of the firearm 12 are broken away in FIG. 1 to show detail. The cartridge magazine 10 is adapted for housing a plurality of stacked cartridges and successively dispensing and guiding the uppermost one of the stacked cartridges from the magazine forward toward an inclined ramp 14 leading to a chamber of a barrel of the firearm 12.

The cartridge magazine 10 comprises a housing portion 22, a magazine follower 24, a follower urging spring 26, and a nose-dive control spring 28. The housing portion 22 comprises a front wall 30, a rear wall 32, a first side wall 34, a second side wall 36 and a pair of cartridge retaining lips 38. Each of the first and second side walls 34, 36 are between the front wall 30 and the rear wall 32. The front, rear and side walls define a cartridge compartment 40 extending along a longitudinal housing axis $X_h$. The cartridge compartment 40 is adapted to contain a plurality of stacked cartridges C. The cartridge compartment 40 has a lower region and an upper region 40*b*. The cartridge retaining lips 38 are disposed along a respective upper edge margin of each of the first and second side walls 34, 36.

Figure 4:
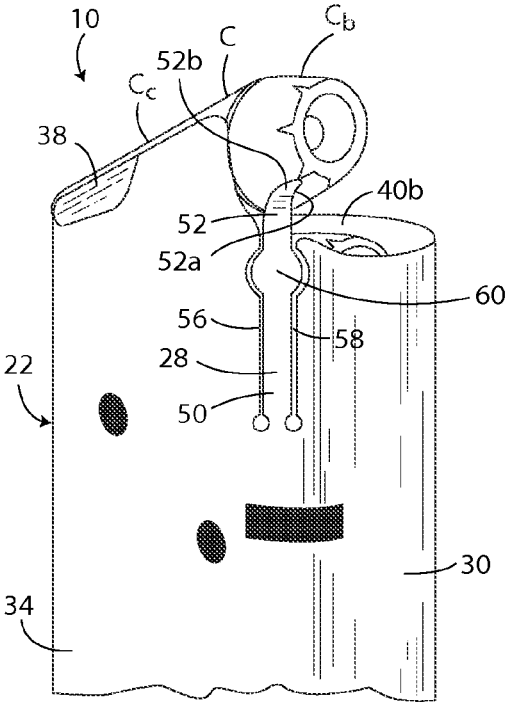
FIG. 4 is an enlarged fragmented perspective view of the cartridge magazine of FIGS. 1-2 similar to FIG. 3, but showing cartridges within the cartridge magazine.

The magazine follower 24 is within the cartridge compartment 40. The magazine follower 24 is adapted and configured to move within the cartridge compartment 40 generally along the housing axis $X_h$. The follower urging spring 26 is preferably a helical spring and is within the cartridge compartment 40. The follower urging spring 26 is adapted and configured to urge the magazine follower 24 toward the upper region 40*b* of the cartridge compartment 40 which presses upwardly against the lowermost cartridge in the stack to position the uppermost cartridge in the stack against the cartridge retaining lips 38. A cartridge C is shown in FIG. 4 in a retaining lips engaging position. The cartridge C has a casing $C_c$ and a bullet $C_b$. When the cartridge C is in the retaining lips engaging position, the cartridge retaining lips 38 of the housing portion 22 engage the casing $C_c$ of the cartridge. The cartridge retaining lips 38 prevent the cartridge C from moving upward along the longitudinal housing axis $X_h$ beyond the cartridge retaining lips. Thus, with the uppermost cartridge C in the retaining lips engaging position, the follower urging spring 26 exerts an upwardly directed force on the cartridge (albeit indirectly via the magazine follower 24 and any other cartridges, if any, that may be between the uppermost cartridge and the magazine follower) and the cartridge retaining lips 38 exert an opposite downward force on the cartridge.

Figure 3:
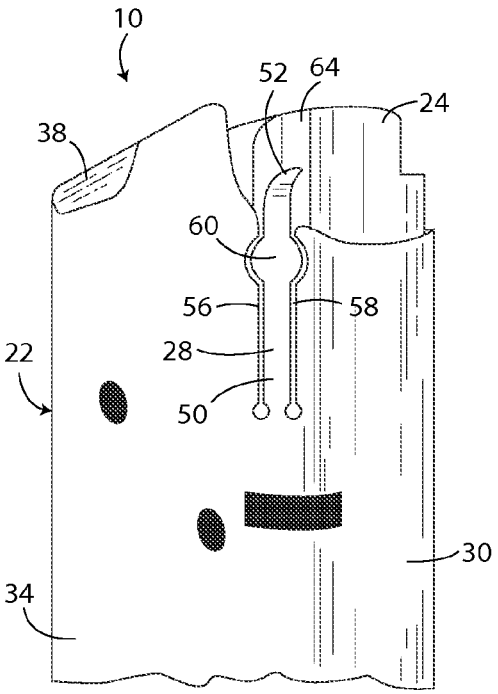
FIG. 3 is an enlarged fragmented perspective view of the cartridge magazine of FIG. 1-2.

Referring to FIGS. 3 and 4, the nose-dive control spring 28 comprises a resilient shank portion 50 and a bullet-engageable end portion 52. The shank portion 50 extends from the first side wall 34 to the bullet-engageable end portion 52. As such, one end of the shank portion 50 is supported by to the first side wall 34 and the opposite end supports the bullet-engageable end portion 52 of the nose-dive control spring 28.

The nose-dive control spring 28 is adapted and configured such that as a cartridge C moves upwardly along the longitudinal housing axis $X_h$ into the retaining lips engaging position (See FIG. 4), the bullet-engageable end portion 52 is engaged by the bullet $C_b$ of the cartridge and forced outwardly until an upper portion of the bullet moves upwardly beyond the bullet-engageable end portion. In other words, as the bullet $C_b$ of the cartridge C moves upwardly along the longitudinal housing axis $X_h$, it presses against a camming surface 52*a* of the bullet-engageable end portion 52 and thereby exerts an outwardly directed force against the bullet-engageable end portion to thereby resiliently flex the shank portion 50 and move the bullet-engageable end portion 52 out of the path of the bullet. Preferably, the camming surface 52*a* of the bullet-engageable end portion 52 is shaped such that when the shank portion 50 is in an unflexed orientation, then the bullet-engageable end portion projects upwardly and inwardly into the path of a bullet $C_b$ moving along the longitudinal housing axis $X_h$. The camming surface 52*a* of the bullet-engageable end portion 52 is shown as a curved surface, but it is to be understood that such surface could be of other shapes (e.g., a flat surface extending upwardly and inwardly) without departing from the scope of this invention. Once the upper portion of the bullet $C_b$ of the cartridge C moves upwardly beyond the bullet-engageable end portion 52 of the nose-dive control spring 28, the shank portion 50 resiliently urges the bullet-engageable end portion inwardly into the upper portion of the cartridge compartment and under a lower portion of the bullet (e.g., to the position shown in FIG. 4). The nose-dive control spring 28 is adapted and configured to prevent the cartridge C from moving into a nose-dive orientation as a breech face 54 of the firearm 12 pushes the cartridge forward toward the inclined ramp 14 of the firearm. In the present embodiment, once the cartridge C is in the retaining lips engaging position with the bullet-engageable end portion 52 under the lower portion of the bullet $C_b$, the shape of the upper surface 52*b* prevents the bullet from engaging the camming surface 52*a*. As such, the exertion of a downward force on the bullet-engageable end portion 52 via the bullet $C_b$, does not result in an outwardly directed force on the bullet-engageable end portion 52 and does not cause the shank portion 50 to flex outwardly. Thus, the nose-dive control spring 28 prevents nose-diving of the cartridge C as the cartridge C is dispensed from the magazine 10.

Preferably, at least the shank portion 50 of the nose-dive control spring 28, the front wall 30, the rear wall 32 and the first and second side walls 34, 36 together constitute at least a portion of a unitary one-piece member. The bullet-engageable end portion 52 could also constitute a portion of such unitary one-piece member. Alternatively, the bullet-engageable end portion 52 may be a separate piece secured to the shank portion 50. Preferably, the walls of the housing 22 and the entirety of the nose-dive control spring 28 are formed together (e.g., by stamping) from a single piece of sheet-metal. Preferably, the forward upper edge of the second side wall 36 (see FIG. 5) of the housing portion 22 does not extend as high as the forward upper edge of the first side wall 34 (see FIG. 3) to thereby facilitate ease of loading of cartridges into the magazine 10. Preferably, the shank portion 50 of the nose-dive control spring 28 is generally flush with the first sidewall 34 when the nose-dive control spring is in its unflexed state. Preferably, the shank portion 50 of the nose-dive control spring 28 extends upwardly from the first sidewall 34 such that first and second generally vertical slits 56, 58 are defined by opposing edges of the shank portion and the first sidewall. The first and second slits prevent the first sidewall 34 of the housing from interfering with the flexing of the nose-dive control spring 28. Preferably, the shank portion 50 of the nose-dive control spring includes a button region 60 adapted and configured to be engaged by a limit screw (not shown) extending through a handle or grip portion of a firearm. The limit screw can be used to adjust the effective stiffness of the nose-dive control spring 28 to thereby increase or decrease the force required to move the bullet-engageable end portion 52 out of the path of a cartridge C moving upwardly along the longitudinal housing axis $X_h$.

Figure 5:
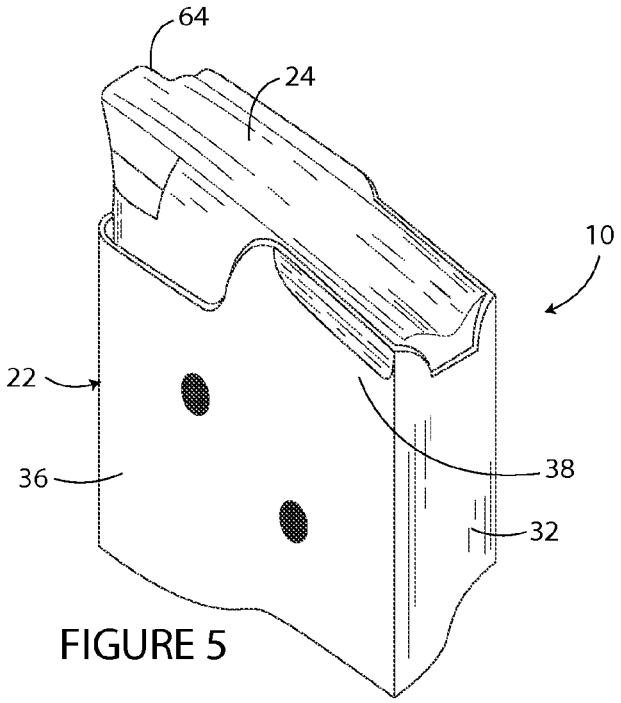
FIG. 5 is an enlarged fragmented perspective view of the cartridge magazine of FIGS. 1-2.

Referring now to FIGS. 3 and 5, the magazine follower 24 is shaped and configured such that the magazine follower avoids contact with the nose-dive limiting spring 28 as the magazine follower moves upwardly in the cartridge compartment 40 generally along the housing axis $X_h$ to a position in which the magazine follower 24 contacts the cartridge retaining lips 38. In particular, the magazine follower 24 preferably includes a clearance notch 64 sized and configured such that the magazine follower avoids contact with the bullet-engageable end portion 52 of the nose-dive limiting spring 28 as the magazine follower moves upwardly along the housing axis $X_h$ to a position in which the magazine follower contacts the cartridge retaining lips. 28.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A cartridge magazine for housing a plurality of stacked cartridges and successively dispensing and guiding the uppermost one of the stacked cartridges from the magazine forward toward an inclined ramp leading to a chamber of a barrel of a firearm, the magazine comprising:

a housing portion comprising a front wall, a rear wall, first and second side walls, and a pair of cartridge retaining lips, each of the first and second side walls being between the front wall and the rear wall, the front, rear and side walls defining a cartridge compartment extending along a longitudinal housing axis, the cartridge compartment being adapted to contain a plurality of stacked cartridges, the cartridge compartment having a lower region and an upper region, the cartridge retaining lips being disposed along a respective upper edge margin of each of the first and second side walls;

a magazine follower within the cartridge compartment, the magazine follower being adapted and configured to move within the cartridge compartment generally along the housing axis;

a follower urging spring within the cartridge compartment, the follower urging spring being adapted and configured to urge the magazine follower toward the upper region of the cartridge compartment;

a nose-dive control spring comprising a resilient shank portion and a bullet-engageable end portion, the shank portion extending from one of the front and side walls to the bullet-engageable end portion, the nose-dive control spring being adapted and configured such that as a cartridge having a casing and a bullet moves upwardly along the longitudinal housing axis, the bullet-engageable end portion is engaged by the bullet of the cartridge and forced outwardly until an upper portion of the bullet moves upwardly beyond the bullet-engageable end portion and the shank portion subsequently resiliently urges the bullet-engageable end portion inwardly into the upper portion of the cartridge compartment and under a lower portion of the bullet thereby urging the cartridge into a retaining lips engaging position, the retaining lips engaging position being a position of the cartridge relative to the cartridge magazine in which the casing of the cartridge engages the cartridge retaining lips while the nose-dive control spring engages the bullet of the cartridge and at least a portion of the bullet extends above the upper edge margin of the first side wall, the nose-dive control spring being adapted and configured to prevent the cartridge from moving into a nose-dive orientation as a breech face of the firearm pushes the cartridge forward toward the inclined ramp of the firearm.

2. The cartridge magazine as set forth in claim 1 wherein the shank portion and bullet-engageable end portion of the nose-dive control spring and at least one of the walls of the housing portion together constitute at least a portion of a unitary one-piece member, and wherein the shank portion of the nose-dive control spring extends upwardly from the first sidewall.

3. The cartridge magazine as set forth in claim 1 wherein at least the shank portion of the nose-dive control spring, the front wall, the rear wall and the first and second side walls together constitute at least a portion of a unitary one-piece member.

4. The cartridge magazine as set forth in claim 3 wherein the bullet-engageable end portion of the nose-dive control spring curves inwardly into the cartridge compartment.

5. The cartridge magazine as set forth in claim 3 wherein the magazine follower is shaped and configured such that the magazine follower avoids contact with the nose-dive control spring as the magazine follower moves upwardly along the housing axis to a position in which the magazine follower contacts the cartridge retaining lips.

6. The cartridge magazine as set forth in claim 5 wherein the magazine follower includes a clearance notch sized and configured such that the magazine follower avoids contact with the nose-dive control spring as the magazine follower moves upwardly along the housing axis to the position in which the magazine follower contacts the cartridge retaining lips.

7. The cartridge magazine as set forth in claim 1 wherein the shank portion of the nose-dive control spring extends upwardly from the first sidewall.

8. The cartridge magazine as set forth in claim 1 wherein the shank portion of the nose-dive control spring, the bullet-engageable end portion of the nose-dive control spring, the front wall, the rear wall, the first and second side walls, and the cartridge retaining lips together constitute at least a portion of a unitary one-piece member.

9. A combination comprising a cartridge magazine as set forth in claim 1 and a cartridge, the cartridge being in the retaining lips engaging position.

10. A cartridge magazine for housing a plurality of stacked cartridges and successively dispensing and guiding the uppermost one of the stacked cartridges from the magazine forward toward an inclined ramp leading to a chamber of a barrel of a firearm, the magazine comprising:

a housing portion comprising a front wall, a rear wall, first and second side walls, and a pair of cartridge retaining lips, each of the first and second side walls being between the front wall and the rear wall, the front, rear and side walls defining a cartridge compartment extending along a longitudinal housing axis, the cartridge compartment being adapted to contain a plurality of stacked cartridges, the cartridge compartment having a lower region and an upper region, the cartridge retaining lips being disposed along a respective upper edge margin of each of the first and second side walls;

a magazine follower within the cartridge compartment, the magazine follower being adapted and configured to move within the cartridge compartment generally along the housing axis;

a follower urging spring within the cartridge compartment, the follower urging spring being adapted and configured to urge the magazine follower toward the upper region of the cartridge compartment;

a nose-dive control spring comprising a resilient shank portion and a bullet-engageable end portion, the shank portion extending from the first side wall to the bullet-engageable end portion, the shank portion and the bullet-engageable end portion of the nose-dive control spring and the first side wall together constitute at a least a portion of a unitary one-piece member, the nose-dive control spring being adapted and configured such that as a cartridge having a casing and a bullet moves upwardly along the longitudinal housing axis into a retaining lips engaging position in which the cartridge retaining lips engage the casing of the cartridge, the bullet-engageable end portion is engaged by the bullet of the cartridge and forced outwardly until an upper portion of the bullet moves upwardly beyond the bullet-engageable end portion and the shank portion subsequently resiliently urges the bullet-engageable end portion under a lower portion of the bullet, the nose-dive control spring being adapted and configured to prevent the cartridge from moving into a nose-dive orientation as a breech face of the firearm pushes the cartridge forward toward the inclined ramp of the firearm, the shank portion of the nose-dive control spring being generally flush with said first side wall when the nose-dive control spring is in an unflexed state.

11. The cartridge magazine as set forth in claim 10 wherein the shank portion of the nose-dive control spring includes an elongate portion of a first width and a button region of a second width, the second width being greater than the first width.

12. The cartridge magazine as set forth in claim 10 wherein the nose-dive control spring, the front wall, the rear wall and the first and second side walls together constitute at least a portion of a unitary one-piece member.

13. The cartridge magazine as set forth in claim 10 wherein the nose-dive control spring, the front wall, the rear wall, the first and second side walls, and the cartridge retaining lips together constitute at least a portion of a unitary one-piece member.

14. A combination comprising a cartridge magazine as set forth in claim 10 and a cartridge, the cartridge being in the retaining lips engaging position.

15. A combination comprising at least one cartridge and a cartridge magazine, the cartridge magazine housing the cartridge, the cartridge magazine being adapted to successively dispense and guide the cartridge from the magazine forward toward an inclined ramp leading to a chamber of a barrel of a firearm, the magazine comprising a housing portion, a magazine follower, a follower urging spring, and a nose-dive control spring, the cartridge having a casing and a bullet;

the housing portion comprising a front wall, a rear wall, first and second side walls, and a pair of cartridge retaining lips, each of the first and second side walls being between the front wall and the rear wall, the front, rear and side walls defining a cartridge compartment extending along a longitudinal housing axis, the cartridge compartment containing the cartridge, the cartridge compartment having a lower region and an upper region, the cartridge retaining lips being disposed along a respective upper edge margin of each of the first and second side walls;

the magazine follower being within the cartridge compartment, the magazine follower being adapted and configured to move within the cartridge compartment generally along the housing axis;

the follower urging spring being within the cartridge compartment, the follower urging spring being adapted and configured to urge the magazine follower toward the upper region of the cartridge compartment;

the nose-dive control spring comprising a resilient shank portion and a bullet-engageable end portion, the shank portion extending from one of the front and side walls to the bullet-engageable end portion, the nose-dive control spring being adapted and configured such that as the cartridge moves upwardly along the longitudinal housing axis into a retaining lips engaging position in which the cartridge retaining lips engage the casing of the cartridge, the bullet-engageable end portion is engaged by the bullet of the cartridge and forced outwardly until an upper portion of the bullet moves upwardly beyond the bullet-engageable end portion and the shank portion subsequently resiliently urges the bullet-engageable end portion inwardly into the upper portion of the cartridge compartment and under a lower portion of the bullet;

the cartridge being within the housing and in the retaining lips engaging position.

* * * * *